US008734591B2

(12) United States Patent
Beshears, Jr. et al.

(10) Patent No.: US 8,734,591 B2
(45) Date of Patent: May 27, 2014

(54) DISHWASHER WITH AUXILIARY, TOUGH SOIL CHEMISTRY DISPENSING SYSTEM

(75) Inventors: Paul E. Beshears, Jr., Stevensville, MI (US); Kristopher L. Delgado, Stevensville, MI (US); Scott D. Slabbekoorn, St. Joseph, MI (US); Barry E. Tuller, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 844 days.

(21) Appl. No.: 12/959,566

(22) Filed: Dec. 3, 2010

(65) Prior Publication Data

US 2012/0138100 A1 Jun. 7, 2012

(51) Int. Cl.
*A47L 15/44* (2006.01)

(52) U.S. Cl.
CPC ..... *A47L 15/4445* (2013.01); *A47L 15/44* (2013.01); *A47L 15/4481* (2013.01); *A47L 15/449* (2013.01)
USPC ..... 134/25.2; 134/57 D; 134/56 D; 134/58 D

(58) Field of Classification Search
None
See application file for complete search history.

(56) References Cited

U.S. PATENT DOCUMENTS

| | | | | |
|---|---|---|---|---|
| 3,612,074 | A * | 10/1971 | Dossey | 134/93 |
| 5,235,994 | A | 8/1993 | Comin et al. | |
| 7,475,696 | B2 | 1/2009 | Vanderroest et al. | |
| 2006/0144424 | A1 | 7/2006 | Marchitto et al. | |
| 2007/0246077 | A1 | 10/2007 | Simmons et al. | |
| 2008/0053494 | A1 | 3/2008 | Moro et al. | |

FOREIGN PATENT DOCUMENTS

| | | | |
|---|---|---|---|
| CN | 2933273 | Y | 8/2007 |
| DE | 60102828 | | 4/2005 |
| EP | 0 755 650 | | 1/1997 |
| EP | 1002494 | A1 | 5/2000 |
| EP | 1319360 | A1 | 6/2003 |
| EP | 1 676 520 | | 7/2006 |
| EP | 0882423 | B1 | 6/2008 |
| GB | 2321590 | A | 8/1998 |
| GB | 2330522 | A | 4/1999 |
| JP | 2008005989 | A | 1/2008 |
| WO | 2009/083576 | A1 | 7/2009 |
| WO | 2009/095638 | A1 | 8/2009 |
| WO | 2010/007050 | A1 | 1/2010 |

* cited by examiner

*Primary Examiner* — Michael Kornakov
*Assistant Examiner* — Ryan Coleman

(57) ABSTRACT

A dishwasher is provided with an auxiliary dispenser to be selectively, conveniently attached to a dish rack for movement with the dish rack into and out of a dishwasher tub, with the dispenser including a storage compartment for housing a washing agent, an inlet leading to the storage compartment and an outlet leading from the storage compartment. When the dish rack is in the recessed position, the inlet of the dispenser is arranged in fluid communication with a fluid conduit system which delivers washing fluid to at least one spray nozzle of the dishwasher, while an outlet of the dispenser leads to a washing compartment of the tub. With this arrangement, at least a portion of the washing fluid directed to the at least one spray nozzle will be forced to flow through the storage compartment in order to pick up additional washing agent for enhanced cleansing purposes.

19 Claims, 5 Drawing Sheets

DISHWASHER WITH AUXILIARY, TOUGH SOIL CHEMISTRY DISPENSING SYSTEM

BACKGROUND OF THE INVENTION

1. Field of the Invention

The present invention pertains to the art of dishwashers and, more particularly, to the incorporation of a tough soil detergent dispensing system in a dishwasher.

2. Discussion of the Related Art

Many attempts have been made in the art of dishwashers to provide improved detergent dispersion and effectiveness. One solution to the problem involves directing a cleaning agent from a dispenser directly into a spray arm. Examples of this type of dispenser are demonstrated by UK Patent Application No. GB 2321590 and U.S. Pat. No. 5,235,994. Another solution involves impinging washing fluid directly into an exposed dispenser container to slowly dissolve and distribute a cleaning agent, as demonstrated by International Publication WO 2009/083576. It is also known in the art to provide an auxiliary dispenser for enhancing the performance of a dishwasher as taught by U.S. Pat. No. 7,475,696.

Despite these prior designs, there is still seen to be a need in the art of dishwashers for an improved cleaning agent dispenser system for use in selectively supplementing the operation of a standard detergent dispenser in providing an optimal amount of detergent for a given washing operation. More specifically, it is seen as beneficial to provide an auxiliary dispenser that can be easily accessed by a user and selectively utilized to aide in the cleaning of heavily soiled kitchenware by quickly and effectively distributing a chemical agent within an intensified wash zone of a dishwasher.

SUMMARY OF THE INVENTION

The present invention is directed to providing a dispensing system for introducing additional chemical washing agents into a washing chamber of a dishwasher including a tub which receives a kitchenware supporting rack for a washing operation. In particular, the dishwasher, in addition to having a main detergent dispenser, is provided with an auxiliary dispenser which can be selectively, conveniently attached to a dish rack for movement with the dish rack into and out of the washing chamber of the dishwasher. The auxiliary dispenser includes a storage compartment for housing supplemental washing agent, an inlet leading to the storage compartment and an outlet leading from the storage compartment. When the dish rack is positioned in the recessed position, the inlet of the auxiliary dispenser is automatically arranged in fluid communication with a fluid conduit system which delivers washing fluid to at least one spray nozzle of the dishwasher. At the same time, an outlet of the auxiliary dispenser is exposed to the washing chamber, either directly or through another portion of the fluid conduit system. With this arrangement, at least a portion of the washing fluid directed to the at least one spray nozzle is forced to flow through the storage compartment in order to pick up additional washing agent for enhanced cleansing purposes.

The use of the auxiliary dispenser is seen to be particularly advantageous in connection with washing tough soils from kitchenware having tough soil thereon, such as soils that are baked on prior to the kitchenware being loaded into the rack, by providing a convenient way to establish a higher level of detergent concentration in the washing fluid directed onto the kitchenware. At the same time, by providing the auxiliary dispenser on the rack, loading of the dispenser is extremely convenient, as is accessing the dispenser if removal from the rack is desired. Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
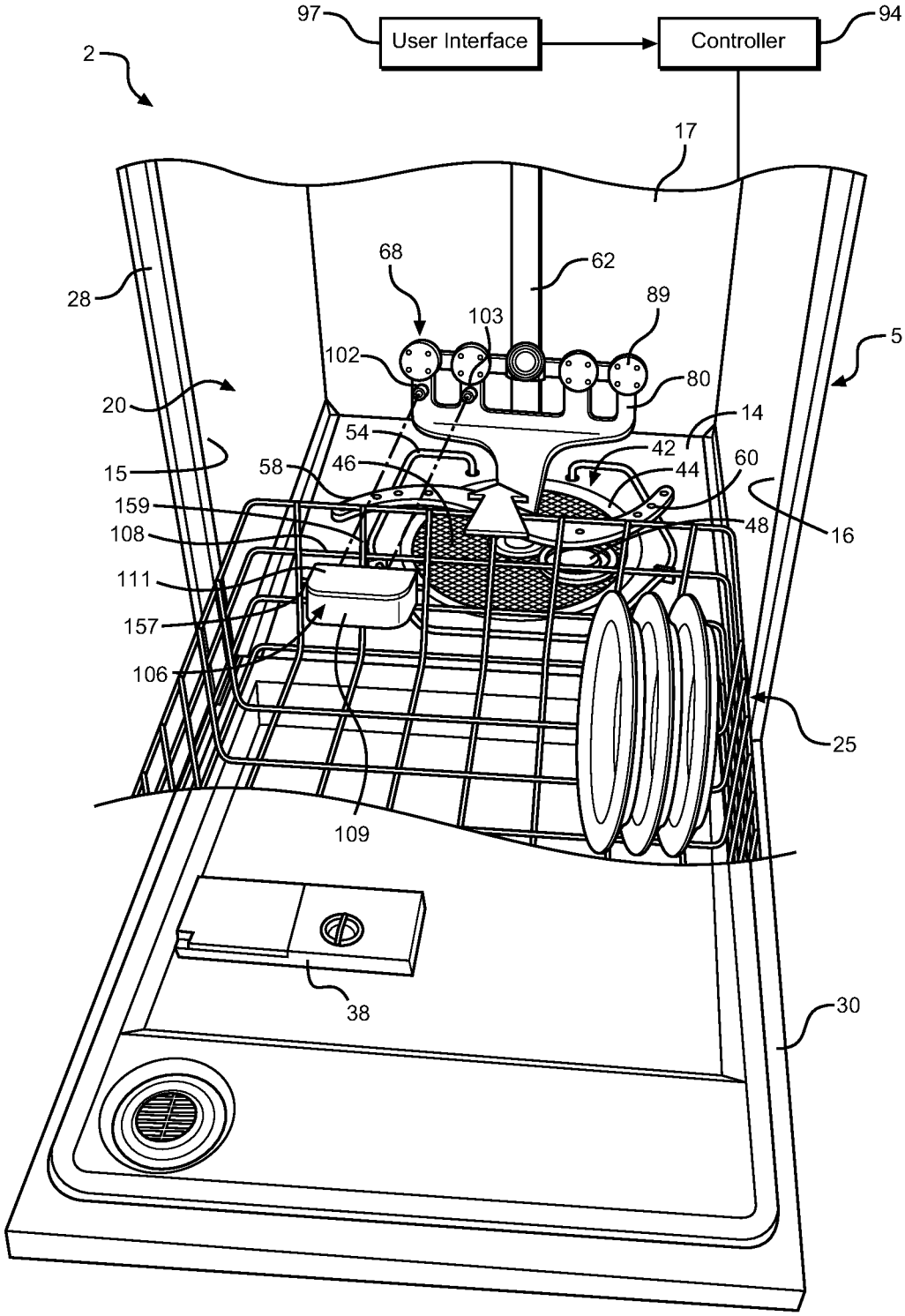
FIG. 1 is a perspective view of a dishwasher incorporating the auxiliary, tough soil chemical dispensing system of the invention.

With initial reference to FIG. 1, a dishwasher for use with the present invention is indicated at 2. As shown, dishwasher 2 includes a tub 5 which is preferably molded of plastic so as to include integral bottom, side and rear walls 14-17 respectively, as well as a top wall (not shown). At this point, it should be recognized that tub 5 could be made from various materials, including stainless steel. Within the confines of walls 14-17, tub 5 defines an interior washing chamber 20 within which soiled kitchenware is adapted to be placed, such as upon a shiftable lower rack 25 and/or an upper rack (not shown), with the kitchenware being cleaned during a washing operation in a manner widely known in the art. Tub 5 has attached thereto a frontal frame 28 which pivotally supports a door 30 used to seal washing chamber 20 during a washing operation. In connection with the washing operation, door 30 is preferably provided with a detergent tray unit 38 within which a consumer can place liquid or particulate washing detergent for dispensing at predetermined portions of the washing operation.

Disposed within washing chamber 20 is a pump and filtration assembly generally indicated at 42. In the preferred embodiment illustrated in this figure, pump and filtration assembly 42 includes a main housing 44, an annular, radially extending strainer 46 and a removable filter unit 48. Extending about a substantial portion of pump and filtration assembly 42, at a position raised above bottom wall 14, is a heating element 54. Heating element 54 preferably takes the form of a sheathed, electric resistance-type heating element. In a manner known in the art, pump and filtration assembly 42 is adapted to recirculate washing fluid to at least a lower wash arm 58 having spaced nozzles 60, and a conduit 62 which leads to the upper spray arm (not shown).

Figure 2:
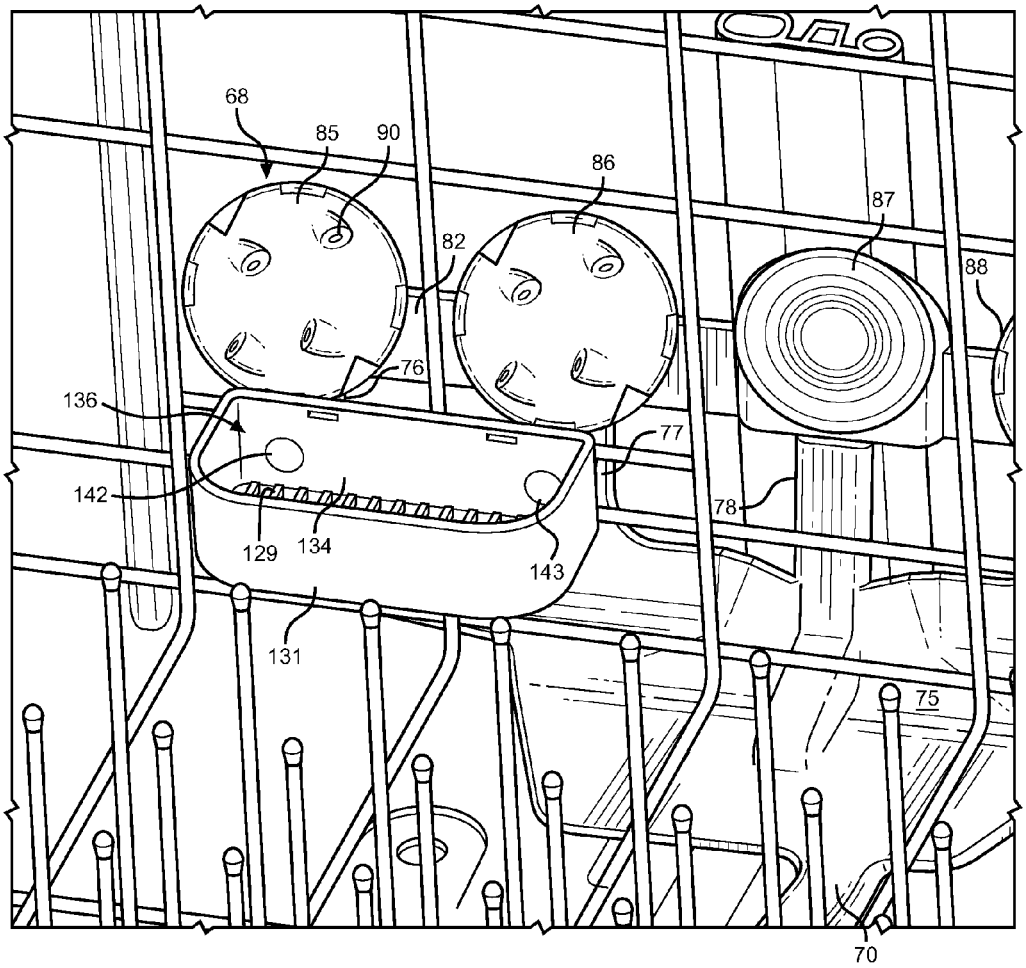
FIG. 2 is an enlarged perspective view of the auxiliary dispensing system of FIG. 1 with a lid removed.
Figure 3:
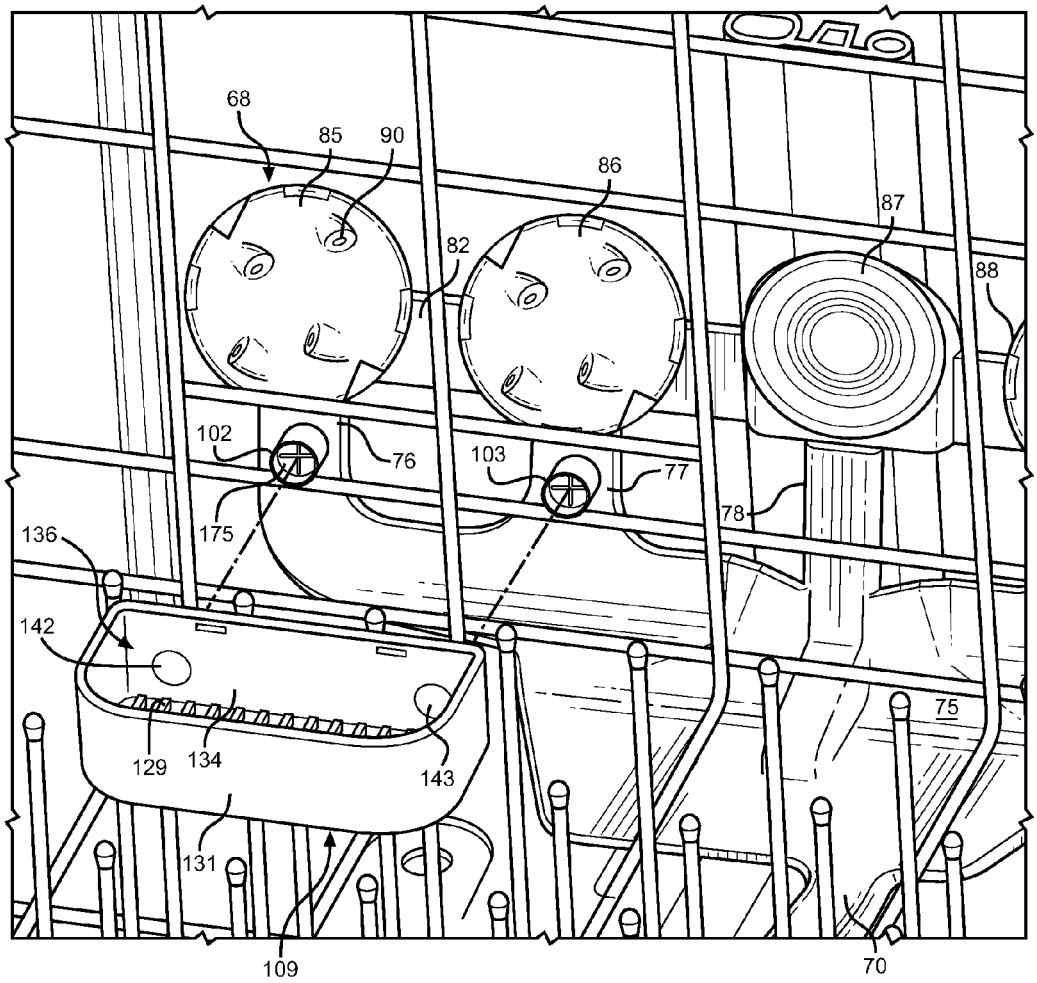
FIG. 3 is an exploded view of the auxiliary dispensing system of FIG. 2.

With particular reference to FIGS. 1-3, dishwasher 2, as illustrated, is also provided with a turbo washer assembly generally indicated at 68. As is known in the art, washer assembly 68 is operable when a user selects, or the machine automatically selects, an intensified wash cycle through interface 97, as opposed to a normal wash cycle. In any case, a main inlet conduit 70 for washer assembly 68 extends from pump and filtration assembly 42 and leads to a manifold 75. Manifold 75 redistributes washing fluid received from main inlet conduit 70 to a plurality of fluid conduits defined by arms 76-80 (also see FIGS. 6 and 7) that are interconnected at an upper end by a cross support 82. Each arm 76-80 is adapted to direct a flow of washing fluid from manifold 75 to a respective nozzle head 85-89, each having various spray nozzles such as represented at 90 for nozzle head 85. In accordance with the arrangement shown, nozzle heads 85, 86, 88 and 89 are adapted to rotate during operation, but could actually be fixed if desired, such as exemplified by nozzle head 87 which is shown mounted in a fixed position so as to essentially constitute a fixed spray head. If a central nozzle head 87 is not needed, this structure can be used as part of the overall mounting system, perhaps with a logo.

Also associated with dishwasher 2 is a controller generally indicated at 94 in FIG. 1, as well as a user interface 97 which is actually, preferably provided on a front surface portion (not shown) of door 30. Basically, the structure of dishwasher 2 described to this point is known in the art and does not form part of the present invention such that this description is simply provided for the sake of completeness. As also widely known in the art, dishwasher 2 is adapted to perform a washing operation with a user selecting desired operation parameters through user interface 97 and also loading liquid or particulate washing detergent in detergent tray unit 38. Upon shutting door 30 to seal washing chamber 20 and initiating the start of the washing operation, controller 94 regulates the operation of pump and filtration assembly 42 and heating element 54 in order to direct washing fluid upon kitchenware placed on at least rack 25. More specifically, tub 5 is partially filled with washing fluid which is circulated and filtered through operation of pump and filtration assembly 42 such that washing fluid is directed to lower wash arm 58 while also being directed through conduit 62 to the upper wash arm (not shown). During a select portion of the washing operation, dispenser unit 38 will open in order to add detergent to the washing fluid for cleansing purposes. Also, if tough stains are expected and the user selects a tough scrubbing washing operation through user interface 97, controller 94 will direct a portion of the washing fluid from pump and filtration assembly 42 into main inlet conduit 70 of washer assembly 68 such that the washing fluid will flow into manifold 75, arms 76-80 and out nozzle heads 85-89 in order to provide a higher pressure, intense washing action in at least a rear portion of rack 25.

Again, this general operation of dishwasher 2 is known in the art and the detailed description thereof is only being provided for the sake of completeness. Of particular importance in connection with the present invention is to address a need for a higher level of detergent concentration in the washing fluid in connection with certain washing operations for dishwasher 2. For instance, in a particularly preferred embodiment of the invention, a higher level of detergent concentration in the washing fluid is desired wherein washer assembly 68 is employed. Therefore, in accordance with the invention, auxiliary ports 102 and 103 are provided on wash arms 76 and 77, with auxiliary ports 102 and 103 being upstream of nozzle heads 85 and 86 and adapted to cooperate with an auxiliary detergent dispenser 106. As will be detailed more fully below and clearly shown in FIG. 1, auxiliary detergent dispenser 106 is adapted to be mounted on a back portion 108 of rack 25 so as to be attached to rack 25 for movement into and out of tub 5. That is, dish rack 25 is mounted for movement between a recessed position within tub 5 and an extended position at least partially outside of tub 5 as shown in FIG. 1. When dish rack 25 is moved to the recessed position, dispenser 106 is automatically arranged in fluid communication between arms 76 and 77 as will be detailed more fully below. At this point, in connection with FIGS. 1-3, it should be simply noted that dispenser 106 includes a cup 109 to which is removably attached a lid 111.

Figure 4:
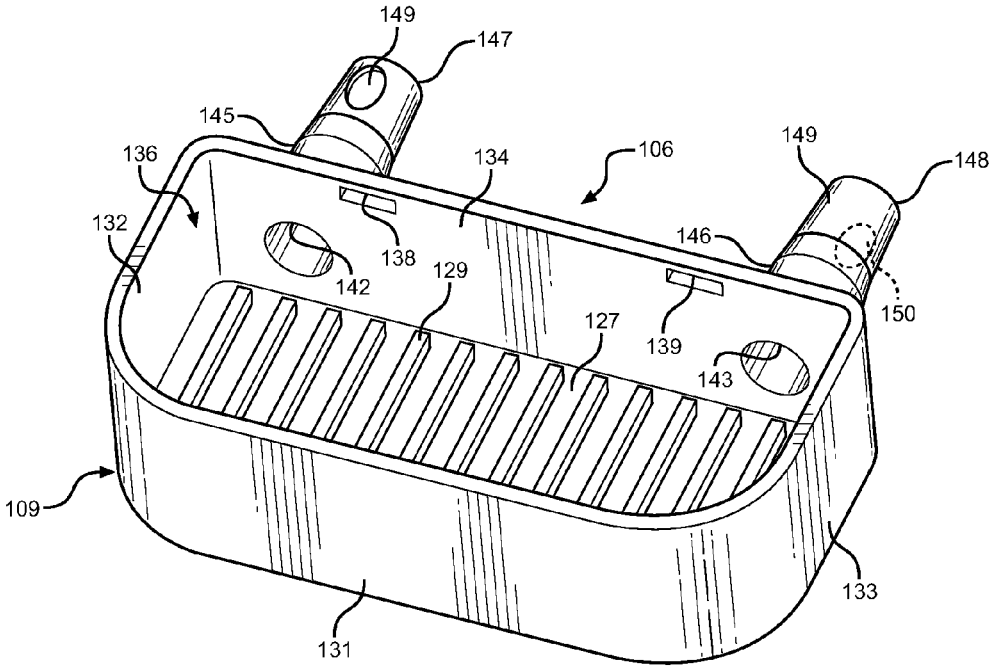
FIG. 4 is a front perspective view of a dispensing container of the auxiliary dispensing system.
Figure 5:
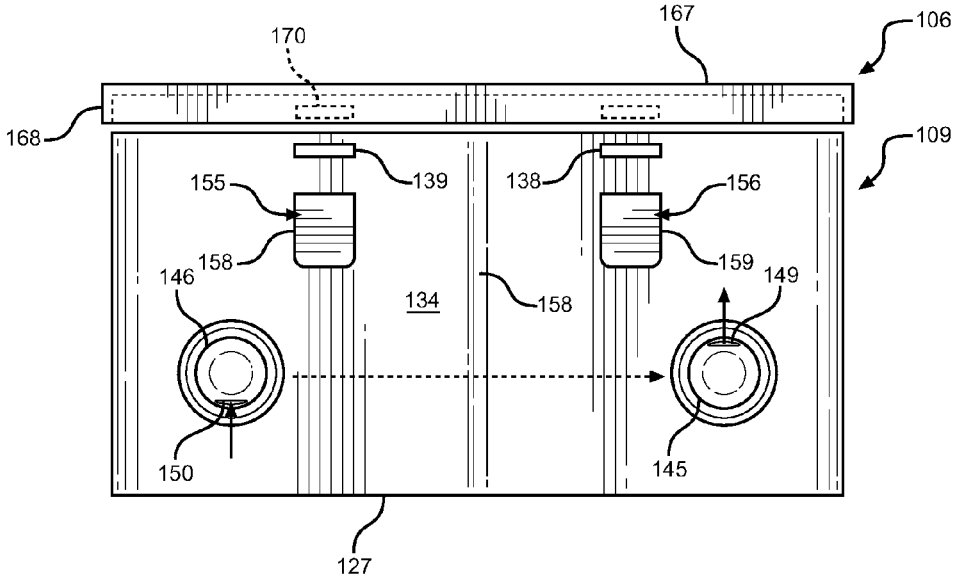
FIG. 5 is a rear elevational view of the dispensing container of FIG. 4.

With particular reference to FIGS. 4 and 5, a detailed description of auxiliary detergent dispenser 106 will now be made. As clearly illustrated, cup 109 of dispenser 106 includes a base 127 that is preferably formed with a plurality of laterally spaced, upstanding rail members 129. Cup 109 is defined by a front wall 131, side walls 132 and 133, as well as a rear wall 134, all of which project upwardly from base 127. In the most preferred embodiment of the invention, cup 109 is molded of plastic so as to be integrally formed with base 127 and walls 131-134 collectively defining an internal storage compartment 136. Arranged at an upper edge portion of rear wall 134 is provided a pair of slotted openings 138 and 139 which are used to retain lid 111 in place as will be described more fully below. Also provided in rear wall 134 is a pair of spaced openings 142 and 143 that lead to respective flow tubes 145 and 146. Each flow tube 145, 146 terminates in a respective curve, closed and tapered terminal end 147, 148 respectively. More specifically, flow tube 145 represents an outlet tube of dispenser 106 and has associated therewith a upper outlet 149 in terminal end 147, while flow tube 146 represents an inlet tube having an associated lower inlet 150.

As best shown in FIG. 5, rear wall 134 is provided with a pair of spaced clips 155 and 156 that are defined by cantilevered arms 158 and 159. With this arrangement, cup 109 can be readily clipped onto back wall portion 108 of rack 25. The structure and spacing of clips 155 and 156 in this particular embodiment are designed to clip onto a horizontal wire 157 of rack 25 while rear wall 134 includes an elongated notch 158 to receive a vertical wire 159 of rack 159 of rack 25 to maintain dispenser 106 in the position shown in FIG. 1. Obviously, given the manner in which dispenser 106 is attached to rack 25, dispenser 106 can be readily removed and replaced as desired. The interaction of clips 155 and 156 with rack 25 and the inclusion of notch 158 establishes an alignment aid for the mounting of cup 109.

At this point, it should be recognized that it is desirable to provide for dispenser 106 to be readily removable from rack 25. However, the particular manner of attachment for dispenser 106 to rack 25, as well as the alignment for dispenser 106, can greatly vary without departing from the invention. To this end, rack 25 can be provided with extra tines, a plate or other alignment aiding structure as well. In any case, as also shown in FIG. 5, lid 111 is defined by an upper plate 167 having an associated annular, peripheral rim 168. Projecting from an inner side of annular rim 168 are a pair of interior projections 170 that are adapted to be received in slotted openings 138 and 139 when lid 111 is tightly, frictionally fit over cup 109. Certainly, lid 111 could be attached to cup 109 in other ways, such as through relative pivoting or sliding movement, to selectively expose storage compartment 136.

With this overall arrangement, additional washing detergent can be readily placed within storage compartment 136 of dispenser 106 by a user, particularly when rack 25 is in the extended position of FIG. 1. That is, when rack 25 is in the extended position, lid 111 can be readily removed from cup 109 to expose storage compartment 136 for the addition of detergent, such as detergent tablets. As will be discussed more fully below, during at least a select portion of the overall washing operation of dishwasher 2, washing fluid will be caused to flow directly through lower inlet 150 and into storage compartment 136 and then out opening 142 and upper outlet 149 prior to being directed into washing chamber 20. In this manner, additional detergent is picked up into the washing fluid and directed into washing chamber 20 for use in connection with cleansing kitchenware on dish rack 25. That is, after supplying detergent into dispenser 106, securing lid 111 onto cup 109 and shifting rack 25 to the recessed position, flow tubes 145 and 146 become automatically registered within auxiliary ports 102 and 103 of wash arms 76 and 77 respectively. With this arrangement, when washing fluid is directed into manifold 75 and towards arms 76 and 77, the washing fluid will be forced to flow from within arm 77 into lower inlet 150 so as so enter storage compartment 136. The washing fluid will then be forced to flow through storage compartment 136 wherein detergent provided therein will be mixed with the washing fluid and redirected out opening 142 and upper outlet 149 in order to enter arm 76. Therefore, some or all of the washing fluid that would have been directed to nozzle 86 will be redirected through dispenser 106, into arm 76 and then to nozzle head 85. Obviously, by picking up the additional detergent, this washing fluid will have an increased detergent concentration and therefore can be used to provide an enhanced washing operation for tough soiled kitchenware arranged in lower rack 25.

If dispenser 106 is removed from rack 25 for a given washing operation(s), it is desired that washing fluid flowing from manifold 75 will still be directed to each of nozzle heads 85-89. For this reason, each of auxiliary ports 102 and 103 is provided with a respective valve assembly 175 (see FIG. 3). In the most preferred form of the invention, each valve assembly 175 defines an elastomeric, one-way flap or split valve which essentially seals off a respective auxiliary port 102, 103 unless the flaps of valve assemblies 175 are deflected based on the insertion of flow tubes 145 and 146 into auxiliary ports 102 and 103. Given the configuration of curved, closed and tapered terminal ends 147 and 148, once flow tubes 145 and 146 are inserted into auxiliary ports 102 and 103, valve assemblies 175 will be automatically opened and the washing fluid will be forced to flow through dispenser 106. Therefore, when dispenser 106 is attached to dish rack 25 for movement with dish rack 25 into and out of tub 5, as dish rack 25 is placed in its recessed position, the inlet 150 of dispenser 106 will be automatically arranged in fluid communication with the fluid conduit system represented by main inlet conduit 70, manifold 75 and arm 77. At the same time, outlet 149 will be automatically arranged in fluid communication with arm 76. With this arrangement, at least a portion of the washing fluid directed to nozzle head 86 will be re-directed through storage compartment 136.

Figure 6:
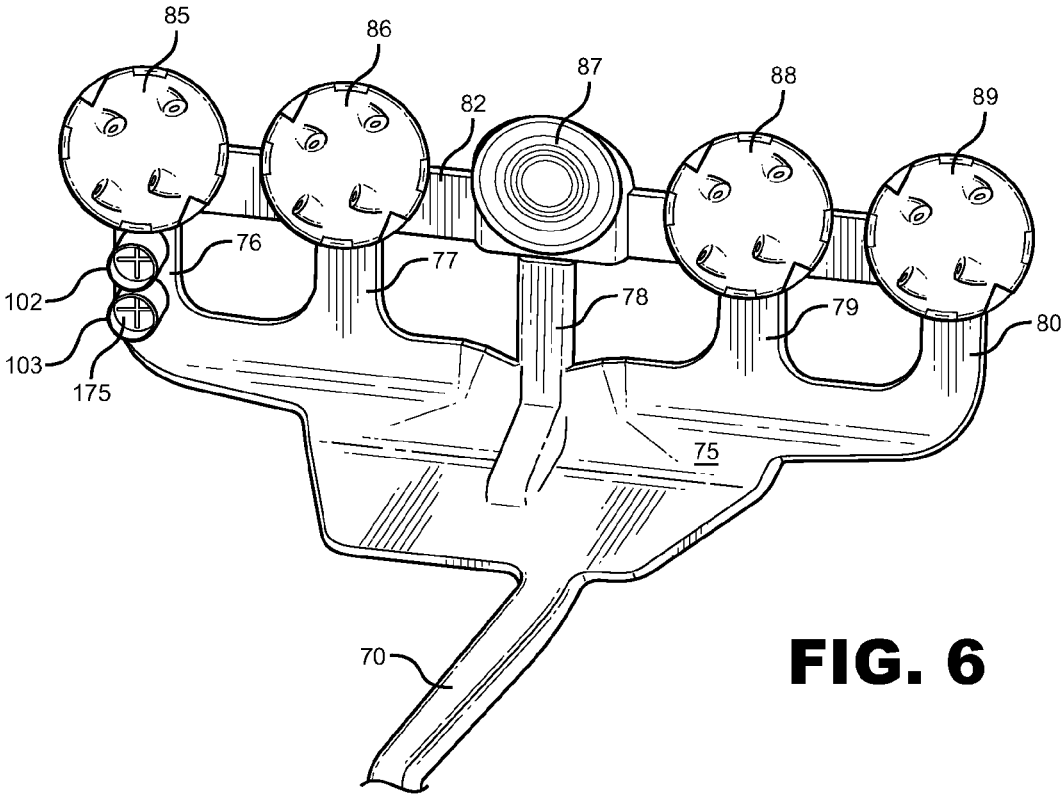
FIG. 6 is a perspective view, similar to that of FIGS. 2 and 3, showing an auxiliary dispensing system in accordance with a second embodiment of the invention.
Figure 7:
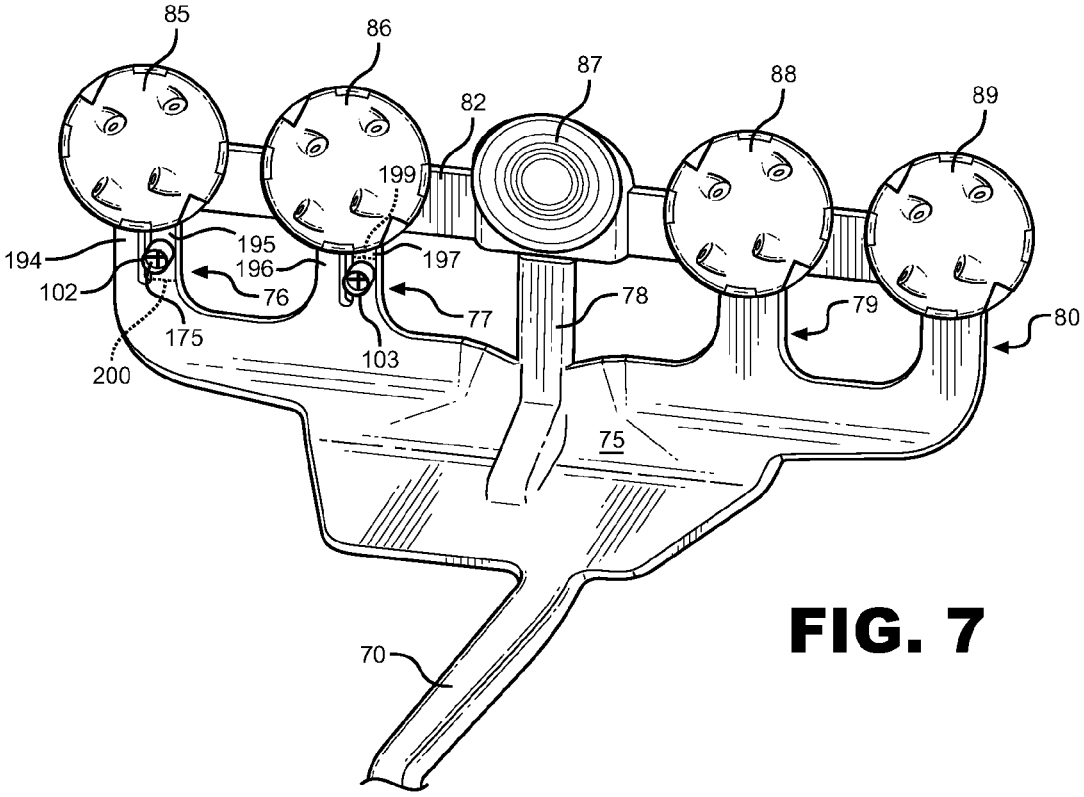
FIG. 7 is a perspective view, similar to FIG. 6, illustrating a third embodiment of the auxiliary dispensing system.

At this point, it should be readily apparent that the objects of the invention can be carried out in various different ways. In the embodiment described above, since the washing fluid directed to nozzle head 86 is redirected through storage compartment 136 to nozzle head 85, nozzle head 86 is either not provided with any washing fluid flow when dispenser 106 is utilized or, at the very least, a reduced volumetric flow. Although it is desired to direct the higher concentrated washing detergent directly through at least one of nozzle heads 85-89 from storage compartment 136, it is possible to have outlet 149 exposed directly to washing chamber 20, such as by mounting dispenser 106 farther to the left on rack 25 as shown in FIG. 1. That is, even such an arrangement would provide for the increased detergent concentration and, given that pump and filtration assembly 42 functions as a recirculatory system, at least a certain higher concentrated washing fluid will eventually reach and be expelled from the various nozzle heads 85-89. Again, there are other ways in which to carry out the invention as well. For instance, as shown in FIG. 6, both auxiliary ports 102 and 103 could be provided on a single arm 76. With this arrangement, fluid flowing from manifold 75 to arm 76 will be directed out auxiliary port 103 through a dispenser 106 having, instead of laterally spaced flow tubes 145 and 146, vertically arranged flow tubes, and then back into arm 76 through auxiliary port 102 prior to reaching nozzle head 85. This embodiment is seen to have the advantage of not eliminating or greatly reducing the washing fluid flow out at least one of the nozzle heads. FIG. 7 shows another embodiment designed to assure that at least a significant flow of washing fluid will reach each nozzle 85-89 by providing auxiliary ports 102 and 103 in bifurcated portions of arms 76 and 77. More specifically, each of arms 76 and 77 are bifurcated so as to establish sub-arms 194-197. With this arrangement, auxiliary port 102 is only provided on sub-arm 195, while auxiliary port 103 is only provided sub-arm 197. Therefore, only the portion of the washing fluid flowing from manifold 75 into sub-arm 197 will be directed through storage compartment 136, thereby assuring that nozzle head 86 will at least receive the flow of washing fluid through sub arm 196. At the same time, nozzle head 85 will receive fluid flow directly from manifold 75 through sub-arm 194, as well as washing fluid with the higher concentration of detergent from storage compartment 136 through sub-arm 195. Since sub-arms 195 and 197 are only utilized to direct fluid to a certain point, sub-arm 197 can be internally closed as indicated at terminal top 199, while sub-arm 195 can be closed at a lower portion as indicated at closed portion 200.

Although described with reference to preferred embodiments of the invention, it should be readily understood that various changes and/or modifications can be made to the invention without departing from the spirit thereof. Instead, it should be perfectly clear that the present invention provides for an auxiliary dispenser to be conveniently attached to a dish rack for movement with the dish rack into and out of a dishwasher tub, with the dispenser including a storage compartment for housing a washing agent, an inlet leading to the storage compartment and an outlet leading from the storage compartment. When the dish rack is in the recessed position, the inlet of the dispenser is arranged in fluid communication with a fluid conduit system which delivers washing fluid to at least one spray nozzle of the dishwasher. With this arrangement, at least a portion of the washing fluid directed to the at least one spray nozzle will be forced to flow through the storage compartment in order to pick-up additional detergent for enhanced cleansing purposes. The preferred embodiments disclosed above are all directed to the use of the dispenser of the invention in connection with a turbo wash assembly. However, it should be readily understood that the auxiliary dispenser arrangement of the invention can be utilized in connection with any spray unit associated with a fluid conduit system of a dishwasher such that, for instance, the dispenser of the invention could be automatically interposed within the flow path associated with conduit 62 to deliver detergent concentrated washing fluid to the upper spray arm upon retraction of the dish rack. Therefore, in general, the invention is only intended to be limited by the scope of the following claims.

What is claimed is:

1. A dishwasher comprising:

a tub including bottom, rear, and opposing side walls defining a washing chamber;

a dish rack mounted for movement between a recessed position within the tub and an extended position at least partially outside of the tub, said dish rack being adapted to support kitchenware to be washed in the washing chamber;

at least one spray nozzle mounted in the tub for spraying washing fluid toward the dish rack during a washing operation;

a fluid conduit system for delivering washing fluid to the at least one spray nozzle;

at least one port opening into the fluid conduit system upstream of the at least one spray nozzle; and a dispenser attached to the dish rack for movement with the dish rack into and out of the tub, said dispenser including a storage compartment for housing a washing agent, an inlet leading into the storage compartment and an outlet leading from the storage compartment wherein, when the dish rack is moved into the recessed position, the inlet of the dispenser is moved into fluid communication with the fluid conduit system through the at least one port such that only a portion of the washing fluid directed to the at least one spray nozzle flows through the storage compartment.

2. The dishwasher of claim 1, wherein the outlet of the dispenser is exposed directly to the washing chamber.

3. The dishwasher of claim 1 wherein the outlet of the dispenser is arranged in direct fluid communication with the fluid conduit system when the dish rack is in the recessed position such that the portion of the washing fluid that flows through the storage compartment is redirected back into the fluid conduit system prior to reaching the at least one spray nozzle.

4. The dishwasher of claim 3, wherein the outlet of the dispenser is arranged vertically above the inlet of the dispenser.

5. The dishwasher of claim 3, wherein the fluid conduit system includes a manifold and a plurality of fluid conduits stemming from manifold; the at least one spray nozzle includes a plurality of spray nozzles in fluid communication with the manifold through respective ones of the plurality of fluid conduits; and washing fluid exiting the plurality of spray nozzles creates an intensified wash zone in the washing chamber.

6. The dishwasher of claim 5, wherein the inlet of the dispenser is interposed in a first one of the plurality of fluid conduits, while the outlet of the dispenser is interposed in a second one of the plurality of fluid conduits.

7. The dishwasher of claim 6, wherein each of the first and second ones of the plurality of fluid conduits is bifurcated to establish separate fluid flows for respective ones of the plurality of spray nozzles and the dispenser.

8. The dishwasher of claim 5, wherein the manifold is provided along the rear wall of the tub, and the dispenser is mounted to a rear side of the dish rack.

9. The dishwasher of claim 1, further comprising: a valve assembly provided at the at least one port wherein, when the dish rack is in the extended position, the valve assembly automatically seals the at least one port.

10. The dishwasher of claim 9, wherein the at least one port includes first and second ports and the valve assembly includes first and second one-way valves at the first and second ports respectively, the first one-way valve being opened by engagement with the inlet of the dispenser to allow the portion of the washing fluid to flow into the dispenser, while the second one-way valve opened by engagement with the outlet of the dispenser to allow the portion of the washing fluid to flow out of the dispenser and, when the dish rack is in the extended position, the inlet and outlet of the dispenser disengage the respective first and second one-way valves such that the valve assembly seals the first and second ports.

11. The dishwasher of claim 1, wherein the dispenser is readily, detachably mounted to the dish rack.

12. The dishwasher of claim 11, wherein the dispenser includes at least one clip detachably securing the dispenser to the dish rack.

13. The dishwasher of claim 1, further comprising:

a door mounted for movement between an open position for accessing the washing chamber and a closed position sealing the washing chamber for the washing operation; and a primary washing agent dispenser provided on the door.

14. The dishwasher of claim 1, wherein the dispenser further includes a lid for covering the storage compartment, said lid being removable to access the storage compartment.

15. A method of operating a dishwasher including a washing chamber, a dish rack for supporting kitchenware to be washed in the washing chamber with the dish rack being movable between an extended, loading position that is at least partially outside the washing chamber and a recessed, operational position that is within the washing chamber, at least one spray nozzle exposed to the washing chamber and a fluid conduit system for directing washing fluid to flow to the at least one spray nozzle during a washing operation, said method comprising:

loading a storage compartment of a dispenser, mounted to the dish rack, with a washing agent;

automatically, fluidly connecting an inlet of the dispenser to a port of the fluid conduit system upstream of the at least one spray nozzle upon retracting the dish rack into the recessed, operational position; and directing washing fluid to flow through the fluid conduit system toward the at least one spray nozzle during the washing operation, with only a portion of the washing fluid directed to the spray nozzle being diverted into the storage compartment of the dispenser and subsequently redirected, along with some of the washing agent, into the washing chamber from the dispenser.

16. The method of claim 15, further comprising: automatically fluidly connecting an outlet of the dispenser with the fluid conduit system upon retracting the dish rack into the recessed, operational position, wherein the portion of the washing fluid, along with the washing agent, are redirected into the washing chamber through the fluid conduit system and the at least one spray nozzle.

17. The method of claim 15, wherein the portion of the washing fluid diverted into the storage compartment is redirected, along with the washing agent, directly into the washing chamber through an outlet of the dispenser.

18. The method of claim 15, wherein: the fluid conduit system includes a manifold and a plurality of fluid conduits stemming from manifold; the at least one spray nozzle includes a plurality of spray nozzles in fluid communication with the spray manifold through respective ones of the plurality of fluid conduits; the washing fluid exiting the plurality of spray nozzles creating an intensified wash zone in the washing chamber; and the dishwasher includes a plurality of selectable operating cycles, including a normal wash cycle and an intensified wash cycle, said method further comprising: directing the portion of the washing fluid into the dispenser when the intensified wash cycle is selected, but not when the normal wash cycle is selected.

19. The method of claim 15, further comprising:

detaching the dispenser from the rack; and automatically maintaining the port sealed when the dispenser is detached from the rack.

* * * * *